US012624919B1

(12) United States Patent
Cunningham

(10) Patent No.: US 12,624,919 B1
(45) Date of Patent: May 12, 2026

(54) FRONT-OPENING HANDGUN HOLSTER

(71) Applicant: Tyler Randall Cunningham, Yuma, AZ (US)

(72) Inventor: Tyler Randall Cunningham, Yuma, AZ (US)

( * ) Notice: Subject to any disclaimer, the term of this patent is extended or adjusted under 35 U.S.C. 154(b) by 17 days.

(21) Appl. No.: 18/632,731

(22) Filed: Apr. 11, 2024

Related U.S. Application Data

(60) Provisional application No. 63/466,435, filed on May 15, 2023.

(51) Int. Cl.
*F41C 33/02* (2006.01)

(52) U.S. Cl.
CPC ..... *F41C 33/0209* (2013.01); *F41C 33/0254* (2013.01)

(58) Field of Classification Search
CPC ..... F41C 33/0209
See application file for complete search history.

(56) References Cited

U.S. PATENT DOCUMENTS 188,402 A * 3/1877 Palm ..... E05D 3/02 16/270
1,641,439 A * 9/1927 Jovino ..... F41C 33/0263 224/244
2,001,321 A * 5/1935 Berns ..... F41C 33/0209 224/666
2,057,269 A * 10/1936 Schreiber ..... E05D 7/1005 16/263
2,347,006 A * 4/1944 Tibbetts ..... A45F 5/02 224/193
2,742,117 A * 4/1956 Tolman ..... E06B 1/603 49/505
2,777,157 A * 1/1957 Burke ..... E05F 1/1261 16/290
2,784,757 A * 3/1957 Bosca ..... A45C 13/1069 206/581
2,853,924 A * 9/1958 Herzfeld ..... G02C 5/2227 16/307
2,893,615 A * 7/1959 Couper ..... F41C 33/0236 224/198
2,934,784 A * 5/1960 Price, Jr. ..... E05F 1/123 16/308
3,008,617 A * 11/1961 Villwock ..... F41C 33/0209 224/183

(Continued)

*Primary Examiner* — Jason W San
(74) *Attorney, Agent, or Firm* — John Rizvi; John Rizvi, P.A.—The Patent Professor®

(57) ABSTRACT

A handgun holster is provided herein which permits the removal of the handgun through the front of the holster as opposed to the traditional vertical removal of the handgun from the holster. The handgun holster comprises a housing having an internal cavity. The housing is defined by two parallel sidewalls which are a fixed distance apart, a fixed rear spacer wall and a front hinged spacer wall. The handgun can be removed from the holster when a person is in a seated position and/or in a more natural motion. This allows the handgun to be more readily produced for use in situations where a user may be in a vehicle, a tight space, or when the holster is mounted horizontally. The hinge is kept closed with sufficient pressure being provided by torsion springs in a hinge mechanism. However, the front hinged spacer wall can be moved to an open position by lifting the gun into a frontal position.

18 Claims, 7 Drawing Sheets

(56) References Cited

U.S. PATENT DOCUMENTS 3,298,135 A * 1/1967 Kinser ..... E05D 7/02 49/382
3,300,809 A * 1/1967 Neerman ..... E05D 5/02 16/389
3,391,420 A * 7/1968 Anderson ..... E05D 11/1064 16/291
3,408,684 A * 11/1968 Marchione ..... E05D 11/1042 16/334
3,448,486 A * 6/1969 Wright ..... E05D 11/1007 16/68
3,538,538 A * 11/1970 Field ..... E05F 1/1215 16/307
3,630,420 A * 12/1971 Bianchi ..... F41C 33/0227 224/193
3,749,293 A * 7/1973 Bianchi ..... F41C 33/0227 224/676
3,825,973 A * 7/1974 Gwozdz ..... E05F 1/1215 16/300
3,865,289 A * 2/1975 Boren ..... F41C 33/0227 224/193
3,910,469 A * 10/1975 Baldocchi ..... F41C 33/0245 224/678
3,977,583 A 8/1976 Bianchi et al.
4,065,039 A 12/1977 Bianchi et al.
4,237,577 A * 12/1980 Chapel ..... E05D 11/0027 16/388
4,277,007 A * 7/1981 Bianchi ..... F41C 33/0209 224/244
4,309,065 A * 1/1982 Pappas ..... F41C 33/0209 224/912
4,323,181 A * 4/1982 Spasoff ..... A01K 97/10 224/684
4,542,841 A * 9/1985 Bianchi ..... F41C 33/0227 224/193
4,598,027 A * 7/1986 Johnson ..... A45F 5/021 156/212
4,823,437 A * 4/1989 Tatara ..... E05F 1/123 16/300
4,834,274 A * 5/1989 Johnson ..... A45F 5/00 224/602
4,858,799 A * 8/1989 Young ..... F41C 33/0209 42/95
5,018,653 A * 5/1991 Shoemaker ..... F41C 33/045 D3/222
5,234,145 A * 8/1993 Padin ..... F41C 33/048 224/192
5,269,448 A * 12/1993 Shoemaker ..... F41C 33/0227 224/672
5,524,979 A * 6/1996 Carson ..... E05D 15/582 188/290
5,855,305 A * 1/1999 Nichols ..... F41C 33/0209 224/244
5,918,784 A 7/1999 Serpa
6,050,464 A * 4/2000 Ramsey, Sr. ..... F41C 27/00 224/931
6,053,383 A * 4/2000 Gunderson ..... A45F 3/14 224/664
6,085,951 A * 7/2000 Beletsky ..... F41C 33/0263 224/244
6,092,703 A * 7/2000 Johnson ..... F41C 33/041 224/198
6,398,089 B1 * 6/2002 Har-Shen ..... F41C 33/0209 224/912
6,854,626 B2 * 2/2005 Liao ..... F41C 33/0263 224/244
7,481,479 B1 * 1/2009 Townson ..... B62D 33/0273 296/146.12
7,562,797 B2 * 7/2009 Senn ..... F41C 33/0263 224/198
7,584,875 B2 * 9/2009 Lowe ..... F41C 33/0236 224/912
7,591,402 B2 * 9/2009 Rassias ..... F41C 33/0263 224/912
8,720,753 B2 * 5/2014 Beneš ..... F41C 33/0236 224/198
8,851,344 B2 * 10/2014 Baumann ..... F41C 33/0263 224/198
8,910,839 B2 * 12/2014 Clifton ..... F41C 33/0209 224/198
8,985,412 B2 3/2015 Rorick et al.
9,004,328 B1 * 4/2015 Galuppo, Jr. ..... F41C 33/0272 224/912
9,022,262 B2 * 5/2015 Pellegrini ..... F41C 33/0227 224/912
9,027,811 B1 * 5/2015 Cannon ..... F41C 33/0236 224/195
9,194,166 B1 * 11/2015 Spiegel ..... E05D 3/02
9,664,480 B2 * 5/2017 Faifer ..... F41C 33/0227
10,077,968 B2 9/2018 Liang
10,352,651 B1 * 7/2019 Vredenburg ..... F41C 33/0236
10,436,550 B2 * 10/2019 Lance ..... F41C 33/0254
10,551,157 B1 * 2/2020 Gargrave ..... A45F 5/021
11,421,958 B1 * 8/2022 Rogers ..... F41C 33/041
11,747,109 B1 * 9/2023 Myers ..... F41C 33/048 224/183
12,006,071 B1 * 6/2024 Allison ..... F28D 15/04
12,018,910 B1 * 6/2024 Christensen ..... F41C 33/0236
2003/0014838 A1 * 1/2003 deOliveira ..... E05D 3/02 16/233
2004/0079776 A1 * 4/2004 Bauer ..... A45F 5/02 224/269
2005/0035162 A1 * 2/2005 Lowe ..... F41C 33/0209 224/912
2005/0184115 A1 * 8/2005 Wells ..... F41C 33/0236 224/193
2007/0163164 A1 7/2007 AVrahami et al.
2008/0121670 A1 * 5/2008 Buress ..... F41C 33/0263 224/243
2008/0179359 A1 * 7/2008 Aberle ..... F41C 33/0245 224/243
2008/0179360 A1 * 7/2008 Lowe ..... F41C 33/0209 224/246
2009/0205168 A1 * 8/2009 Guo ..... H05K 5/0226 16/308
2011/0271484 A1 * 11/2011 Irwin ..... E05F 1/1284 16/273
2013/0014345 A1 * 1/2013 Park ..... E05D 5/06 16/248
2013/0111706 A1 * 5/2013 Anderson ..... E05D 11/087 16/342
2013/0299534 A1 * 11/2013 Rorick ..... F41C 33/0236 224/243
2013/0299543 A1 * 11/2013 Rorick ..... F41C 33/0263 224/674
2013/0301243 A1 * 11/2013 Rorick ..... F41G 1/00 362/110
2015/0233671 A1 * 8/2015 Schmadeka ..... F41C 33/0209 224/587
2015/0285587 A1 * 10/2015 Abushaev ..... F41C 33/02 224/193
2015/0345898 A1 * 12/2015 Bardy ..... F41C 33/02 224/244
2016/0025452 A1 * 1/2016 Crye ..... F41C 33/048 224/587
2016/0160545 A1 * 6/2016 Tolliver ..... E05D 3/02 16/374
2016/0249718 A1 * 9/2016 Oh ..... A45F 5/00 455/575.6
2018/0224240 A1 * 8/2018 Sereday ..... F41C 33/0263
2018/0238650 A1 * 8/2018 Stockton ..... F41A 17/44
2019/0128640 A1 * 5/2019 Shinkle ..... F41C 33/041
2020/0232755 A1 * 7/2020 Houck ..... F41C 33/0227
2020/0232756 A1 * 7/2020 Hamilton ..... F41C 33/0236

(56) References Cited

U.S. PATENT DOCUMENTS

| | | | | |
|---|---|---|---|---|
| 2023/0121728 | A1* | 4/2023 | Smith | F41C 33/0263<br>224/663 |
| 2023/0193671 | A1* | 6/2023 | Kashiwaguma | E05D 5/06<br>16/233 |
| 2025/0085083 | A1* | 3/2025 | Giordano, Jr. | F41C 33/0236 |

* cited by examiner

FRONT-OPENING HANDGUN HOLSTER

CROSS-REFERENCE TO RELATED APPLICATIONS

This application claims the benefit of U.S. Provisional Patent Application Ser. No. 63/466,435, filed on May 15, 2023, which is incorporated by reference herein in its entirety.

FIELD OF THE INVENTION

The present invention relates generally to the field of firearms. More particularly, the present invention relates generally to holsters for firearms, and more specifically, holsters for handguns.

BACKGROUND OF THE INVENTION

The history of the United States is replete with the presence of firearms. While historically, the use of firearms tended towards the purposes of national defense and hunting, with the advent of the 19th century, more and more firearms were produced and carried for the purposes of personal defense. Most often these firearms were handguns, such as revolvers, which were generally carried on the dominant side hip of the user in a hip holster. Since the public carry of firearms was not generally prohibited during this period of history, the concealment and/or surreptitious carry of firearms was not largely prevalent.

With the advent and progression of the 20th century, and the migration of populations to city centers, there was an increase in the density of many cities. This resulted in more restrictions being put into effect on the open and/or concealed carry of most firearms. However, handguns did still remain in public view, particularly for military and law enforcement personnel. These personnel continued to carry a handgun in a holster in order to hold it securely. While holsters can be worn in a number of ways, such as on a belt at the waist, under an armpit, or around an ankle, the majority of such noted military or law enforcement personnel continued to largely holster their weapon on their hip.

Throughout the 20th century most handguns transitioned to the use of semi-automatic pistols as opposed to revolvers. The semi-automatic pistol could hold more ammunition and was more easily reloadable. Along with the advent of the semi-automatic pistol, there were increasing incidents which required that military and law enforcement personnel be required to access their firearms more quickly and in different scenarios. For example, military personnel started to need to quickly unholster their weapon in the event of an ambush or surprise attack. Likewise with the gradual increase in crime and emboldening of criminals, law enforcement personnel saw the need to be able to quickly address violent crimes such as robberies and carjackings with a quick presentment of their side arms.

These scenarios have continued up and through today. Certain users of handguns must be still able to remove a handgun quickly and easily from a holster regardless of the type of holster used. Additionally, these users need to be assured that, when not in use, the handgun will remain safely in the holster.

As to the issue of safe storage, these needs have been met by various holster designs that have incorporated straps, flaps, hood enclosures, and the like, to secure the handgun therein. However, these solutions generally require the unfastening of these enclosures before drawing the handgun. This can take an unacceptable amount of time in exigent circumstances, e.g., combat.

Also, in some instances, the handgun can be equipped with an accessory, such as a silencer, a light and/or a laser sighting device, in which case, the holster must be capable of accommodating such accessories, yet still enable the gun to be removed from the holster with a quick and short draw, preferably with a length that is shorter than the overall length of the gun and accessory combination.

Still further, law enforcement personnel have at times been the target of unprovoked attacks by gun-wielding criminals. This has occurred in certain instances when the law enforcement officers are seated in a seated patrol car. In addition, police patrol cars tend to be full of various equipment which makes the available space to move around quite limited, and thus, makes it even harder for police officers to quickly unholster their weapons in such cramped positions.

Therefore, despite an increase in methods of retaining a handgun in a holster, there has not been a commensurate development in methods which allow a user to quickly release the handgun using one hand only. Therefore, a need exists for an improved handgun holster that can be easily operated with the same hand that withdraws the firearm from the holster and wherein the handgun can be removed from the holster while in a seated position.

SUMMARY OF THE INVENTION

The present invention can be directed to a handgun holster which permits the removal of a handgun through the front of the holster as opposed to the traditional vertical removal of the handgun from the holster. The handgun holster comprises a housing having an internal cavity. The housing is defined by two parallel sidewalls which are a fixed distance apart, a fixed rear spacer wall and a front hinged spacer wall. The hinged front spacer wall allows for a handgun to be removed from the holster when a person is in a seated position.

While not wishing to be bound by theory, it is believed that the handgun holster described herein allows the handgun to be more readily produced for use in situations where a user may be in a vehicle, a tight space, or when the holster is mounted horizontally, and also permits the handgun to be presented in a more natural motion. Since the hinge is kept closed with sufficient pressure by torsion springs in a hinge mechanism, the handgun can be secured from falling out of the holster. Also, since the handgun has a shorter distance to travel by coming out from a frontal position as opposed to a traditional vertical position, the handgun can be produced more quickly. Finally, since the handgun and any attachments thereto, such as a laser, a light or a scope are held within the housing cavity, and since the front spacer wall is the same width as the rest of the holster, the removal of the handgun with the noted attachments from a frontal position avoids having these components snagging on the walls of the holster, which could occur in a traditional draw handgun holster or if the front spacer wall was narrowed.

The term "about" as used herein can entail a variance of 10% greater or lower than the value recited.

The term "comprising" as used herein also encompasses the terms "consisting essentially of" and "consisting of".

The expression "front-opening" as used herein can be understood to mean that the holster opens along the portion of the holster that corresponds to the top of the handgun, i.e., the barrel, or the top of the slide portion of the handgun when the handgun is placed in the holster which is mounted on a hip position.

The values of any endpoint(s) of any range(s) recited herein can be used to create different ranges or different endpoints of ranges to those described herein. The endpoints in any of the ranges described herein can also include any integer value in the recited range even if not expressly described. Thus, for example, a range of from 1.0 to 10 can include as alternate range endpoints any integer between 1 and 10, such as, the non-limiting integer examples of 2, 3, 4, 5, 6, 7, 8 and 9.

In a first implementation of the invention there can be provided a front-opening handgun holster comprising:

a housing having an internal cavity which is defined by:
- two substantially parallel side walls having substantially identical rear sidewall edges, and opposing front edges, one of the front edges being a spring hinge front edge which is configured for reception of a spring mechanism,
- a fixed rear spacer wall located between the side walls, and which is flush with the rear sidewall edges, and
- a front spacer wall having a spring hinge end which mates with the spring hinge front edge and an opposing closure end which overlies the other front edge; and, a spring mechanism comprising a dowel and at least two torsion springs, which are configured to fasten the spring hinge end of the front spacer wall to the spring hinge front edge.

In one aspect of the invention, the handgun holster can be of a size and configuration to accommodate either a semi-automatic pistol or a revolver. The handgun holster can be made of any suitable materials such as plastic, e.g., thermoplastic acrylic-polyvinyl chloride, such as Kydex, injection molded polymer, leather, nylon and combinations thereof, or any other material commonly used to manufacture handgun holsters.

In another aspect of the invention, the housing can be of any suitable shape which can accommodate a specific type of handgun or can be a generic shape which can accommodate many different types of handguns.

In yet even another aspect of the invention, the internal cavity of the housing can be planar or can be shaped to accommodate a specific brand and/or type of handgun, e.g., as semi-automatic pistol or a revolver, or more specifically a single stack or double stack semi-automatic pistol, and/or of any suitable caliber such as .22, .32, 380, 9 mm, 40, 45, 38 special, 357 Mag, and 44 Mag.

In yet another aspect of the invention, the housing can have a rectangular opening along the top, i.e., the traditional opening/removal area of a handgun holster, i.e., the opening which permits for vertical removal of the handgun when it is oriented in its conventional orientation on the hip of a user. The front opening of the handgun can be rectangular and perpendicular to the sidewalls.

In yet one other aspect of the invention, the two substantially parallel side walls are flat, although three dimensional side walls which accommodate a particular handgun or type of handgun are also envisioned herein. The term "substantially" as used with regard the "two substantially parallel side walls" is understood to mean that the side walls are either completely parallel or can optionally have slight angling from the top of the holster towards the opposing bottom of the holster, e.g., wherein the angling is from 1 degree up to 15 degrees, preferably from 5 degrees to 10 degrees, from a plane which bisects the two substantially parallel side walls. The sidewalls can preferably be flat and planar. In another embodiment, the sidewalls can be fixed a width distance apart of from about 1 inch to about 3 inches, preferably from about 1 inch to about 2 inches apart, the width distance being able to accommodate the width of the handgun.

The sidewalls can be of a height such that when the handgun is placed in the holster between the sidewalls, the sidewalls are of a height which is sufficient to cover the trigger, trigger guard and at least 50%, preferably at least 75% of the length of the barrel of the handgun. The height being understood herein to mean the distance from the conventional insertion/draw opening in a handgun holster to a lower end of the holster, e.g., wherein the muzzle/barrel may protrude. In one embodiment, the sidewalls can be of a height such that the muzzle and a portion of the barrel of the handgun protrudes from the bottom of the sidewalls. More specifically, the sidewalls can be of a height of from about 4 inches up to about 8 inches, more preferably from about 5 to about 6 inches.

In yet even one other aspect of the invention the sidewalls of the housing can have parallel and flush top and bottom edges of the sidewalls. In one embodiment the sidewalls, fixed rear spacer wall, and the front spacer wall can each have the same or separate thickness of from about $1/16^{th}$ of an inch up to about ⅓ of an inch, preferably from about ⅛ of an inch up to about ¼ of an inch and preferably the sidewalls can be of an equivalent thickness throughout although different thicknesses of the sidewalls in different portions of the holster to accommodate different characteristics of the handgun, such as moving parts or the trigger, can be envisioned.

In yet still one other aspect of the invention, the parallel sidewalls can have rear sidewall edges which are preferably identical. Preferably the rear sidewall edges can be curved along the height of the holster, i.e., from the top of the holster sidewalls to the bottom of the holster sidewalls, such that the length of the sidewalls from the rear sidewall edges to the opposing front edges decreases from the top of the holster to the opposing bottom of the holster. Preferably the top of the holster has sidewalls which have a length of from about 3 inches up to about 8 inches, preferably from about 4 inches up to about 6 inches. In contrast the length of the sidewall edges at the bottom of the holster can be from about 1 inch up to about 3 inches, preferably from about 1 inch to about 2 inches. The height of the fixed rear spacer wall and front spacer wall can comport with the height of the sidewalls as described herein with the understanding that the fixed rear spacer wall can be curved and thus, the height of the curved fixed rear spacer wall mentioned does not take into account the curvature length but rather the length of a straight line from the top of the fixed rear spacer wall to the bottom thereof.

In yet still even another aspect of the invention, the front edges of the sidewalls can have different configurations. One of the front edges of the sidewalls can be a spring hinge front edge which can be understood to mean that it is configured for reception of a spring mechanism. Such can entail that the spring hinge front edge has a protruding centrally located section (i.e., centrally located along the height of the spring hinge front edge) which is flush with plane of the side wall and has a rounded edge and can contain a channel therethrough. The protruding centrally located section can be from about 2 to about 6 inches, preferably from about 3 to about 4 inches. The spring hinge front edge can also contain flat sections which are indented from the length of the protruding centrally located section, preferably indented at a distance which comports with the thickness of the front spacer wall described herein. The height of the indented sections can be from about 1 inch up to about 3 inches, preferably from about 1 inch to about 2 inches. In one embodiment the length of the sidewall with the front edge that is other than the spring hinge front edge can be commensurate with the length of the sidewall up to the indented portion of the spring hinge front edge thereof. The front edge which is other than the spring hinge front edge can also be referred to herein as the closure front edge. The closure front edge can be flat and have the same height as the sidewalls.

In one other aspect of the invention herein, the fixed rear spacer wall can be curved in accordance with the curvature of the rear sidewall edges and can be located between the sidewalls, preferably at the ends thereof, i.e., such that an outside surface of the fixed rear spacer wall is flush with the rear sidewall edges. The fixed rear sidewall can be permanently adhered to, fastened with or formed with the sidewalls such that it is not moveable or displaceable. The fixed rear spacer wall being located between the sidewalls can have a width that comports with the fixed spacing of the parallel sidewalls described herein.

In another aspect of the invention herein, the front spacer wall has two height wise edges, i.e., a spring hinge end and an opposing closure end. The spring hinge end has a centrally located indentation along its height which comports with, and when in place, mates with the height of the protruding centrally located section of the spring hinge front edge. The two portions of the spring hinge end which are above and below the centrally located indentation each can have a channel therein which comports with the diameter of the channel in the protruding centrally located section described above. The width of the front spacer wall is not measured along the centrally located indentation, but along the top or bottom of the width of the front spacer wall and can be from about 2/16ths of an inch up to about 2/3 of an inch greater than the width of the of the fixed rear spacer wall. The front spacer wall can have the same height as the sidewalls.

In yet another aspect of the invention herein the front-opening handgun holster can contain a spring mechanism comprising a dowel and at least two torsion springs. The dowel can be of a diameter that comports with the diameter of the channel in the protruding centrally located section and the channel in the portions of the spring hinge end which are above and below the centrally located indentation. The dowel can be of a length which comports with the height of the front spacer wall. The dowel can be placed through the top or bottom portion of the spring hinge end which are above and below the centrally located indentation of the front spacer wall and also through the channel in the protruding centrally located section with one of each of the two torsion springs located above and below the channel in the protruding centrally located section.

The torsion springs can be of a kind and configuration such that when placed in such a position they exert a closing force on the front spacer wall such that it lies closed against the front edges of the sidewalls but only with sufficient force to retain the handgun in the holster. The torsion springs can be metal or plastic, preferably metal. Such a front spacer wall with the spring mechanism in place can be opened along the hinged end by the movement of the handgun through the front of the holster. In one non-limiting example the torsion spring has a torsion force or torque for traveling 90 degrees of from about 0.05 pounds *in to about 5 pounds *in, preferably from about.25 pounds *in to about 3 pounds*in, even more preferably from about 0.5 pounds*in to about 2 pounds*in. The torsion spring rate is the amount of force per 360 degrees of radial travel. Torsion force is noted in pounds of force per inch. This can be further broken down into the amount of force per degree by simply dividing it by 360 degrees. The torsion spring rate per degree is useful in determining the amount of force required to torque the torsion spring a particular amount of degrees, for example 90 degrees which can be the radial distance required to open the front spacer wall such that it is in the same plane as the side wall along which it is hinged.

In a further embodiment, the closure end of the front spacer wall can be retained in a closed position, i.e., perpendicular to, and flush with, the closure front edge of the sidewall which is the sidewall edge which is other than spring hinge front edge. As noted above, such can be done through the spring energy of the spring mechanism, specifically the torsion springs as described herein. Alternatively, the front spacer wall and/or the side wall, adjacent to the front closure front edge can have a button or latch mechanism which retains the front spacer wall in a closed position until a user is ready to draw the weapon contained therein. The latch mechanism can be any conventional latch components which can be entirely on the front spacer wall or adjacent, i.e., within from about 0.25 inches up to about 2 inches from the closure front edge of the sidewall. In another embodiment, the latch mechanism can comprise two or more parts which are split in their interacting components in terms of the location or fixation between the front spacer wall and the adjacent location to closure front edge of the sidewall as set out above.

In a second implementation of the invention there can be provided herein a method of removing a handgun from a holster comprising:

- providing the herein described front-opening handgun holster;
- fastening the front-opening handgun holster to an article of clothing;
- inserting a handgun into the front-opening handgun holster; and,
- removing the handgun through the front spacer wall of the front-opening handgun holster.

In one aspect of the invention, the method can further comprise wherein the article of clothing is a belt or a tactical clothing article.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
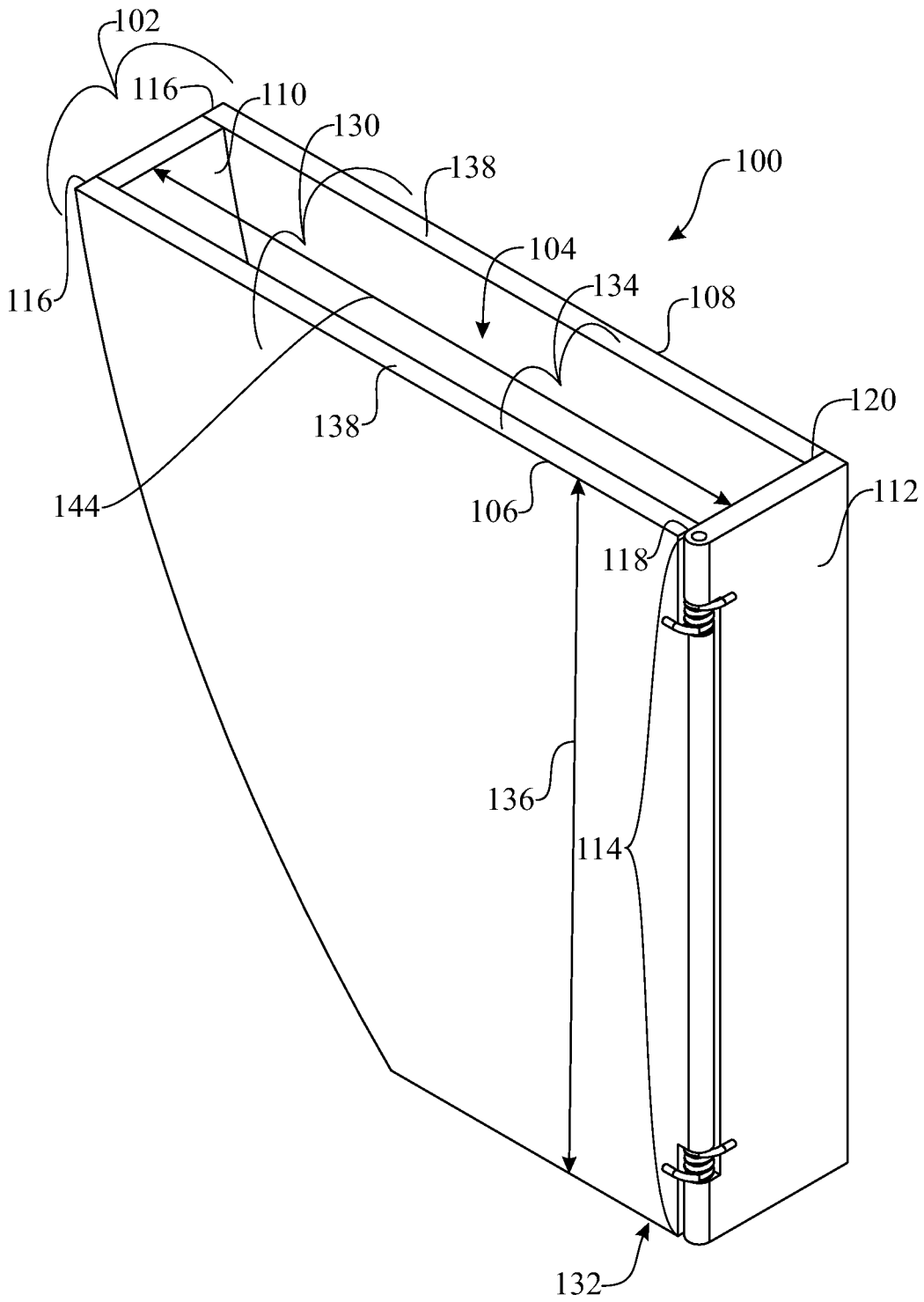
FIG. 1 is a perspective view of the front-opening handgun holster of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1-3 and 6, there is provided a front-opening handgun holster 100 (hereinafter holster 100). Holster 100 can have a housing 102 having an internal cavity 104. The internal cavity 104 can be defined by two substantially parallel side walls 106 and 108 (herein after side walls 106/108), a fixed rear spacer wall 110 and a front spacer wall 112. The holster 100 can also comprise a spring mechanism 114.

Still referring to FIGS. 1-3 and 6, the sidewalls 106/108 can have rear sidewall edges 116, which can be identical, and opposing front edges 118 and 120, also referred to as spring hinge front edge 118 and the other front edge 120. The front spacer wall 112 can have a spring hinge end 122 and an opposing closure end 124. Spring mechanism 114 can comprise a dowel 126 and torsion springs 128. The spring hinge front edge 118 can be configured for reception of the spring mechanism 114, i.e., the dowel 126 and torsion springs 128.

Still referring to FIGS. 1-3 and 6, the housing 102 can have a rectangular opening defined by side walls 106 and 108, fixed rear spacer wall 110 and front spacer wall 112 along the top 130 of the holster 100 and can likewise have a rectangular opening along the bottom 130 of the holster 100. The front spacer wall 112 can be rectangular and perpendicular to the side walls 106 and 108. The sidewalls 106 and 108 can be set a fixed width distance 134 apart. The sidewalls 106 and 108 can have a height 136 and can have top 138 and bottom 140 edges thereof.

The sidewalls 106 and 108, fixed rear spacer wall 110, and the front spacer wall 112 can each have the same thickness 142. The rear sidewall edges 116 can be curved along the height 136 of the holster 100, i.e., from the top 130 of the holster sidewalls 106/108 to the bottom 132 of the holster sidewalls 106/108, such that the length 144 of the sidewalls 106/108 from the rear sidewall edges 116 to the opposing front edges 118/120 decreases from the top 130 of the holster 100 to the opposing bottom 132 of the holster 100. The fixed rear spacer wall 110 can be located between the side walls 106/108 and simultaneously flush with the rear edges 116.

Figure 6:
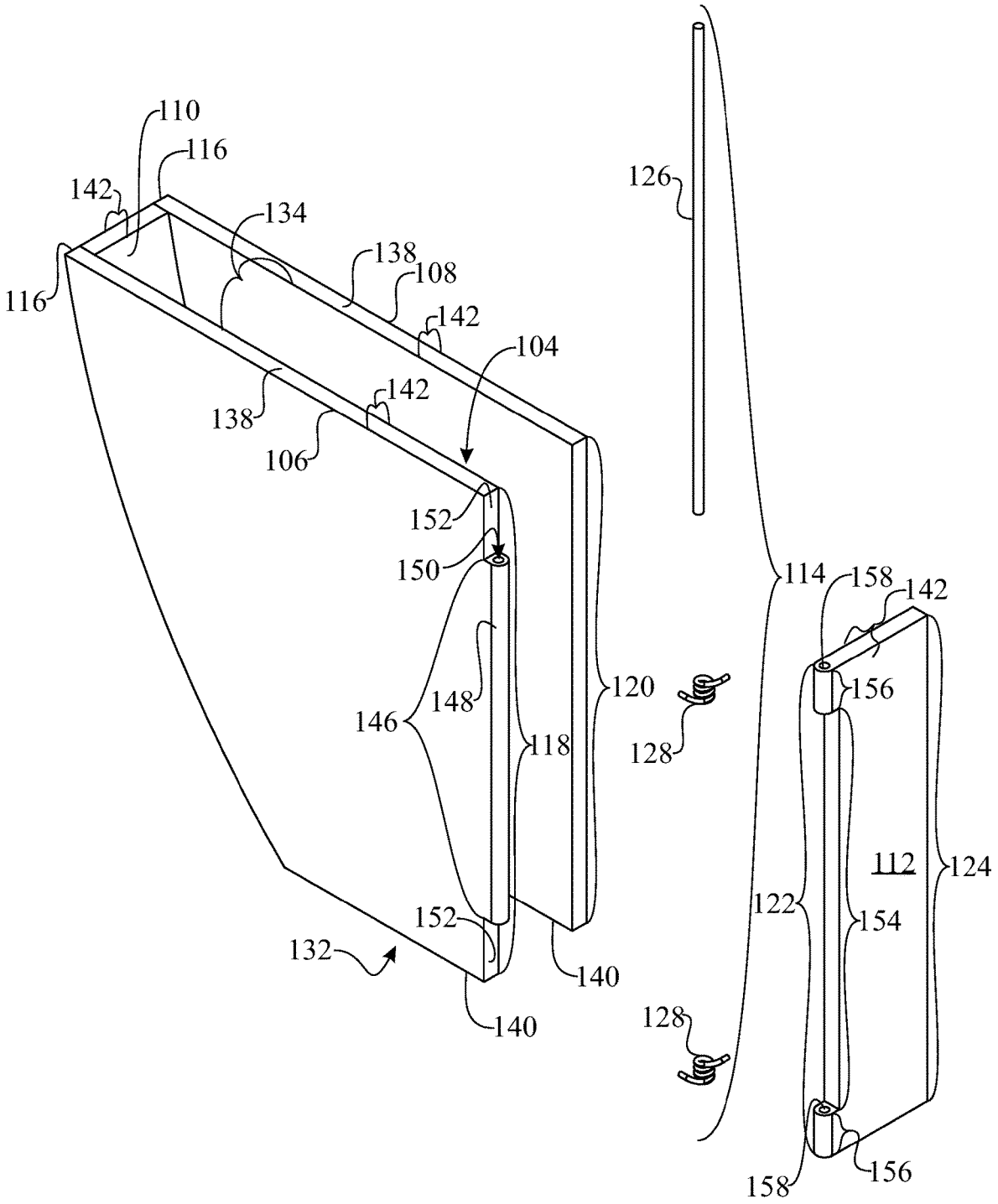
FIG. 6 is an exploded view of the front-opening handgun holster of FIG. 1; and, FIG. 7 is a close-up view of the dowel and torsion spring mechanism of the front-opening handgun holster.
Figure 7:
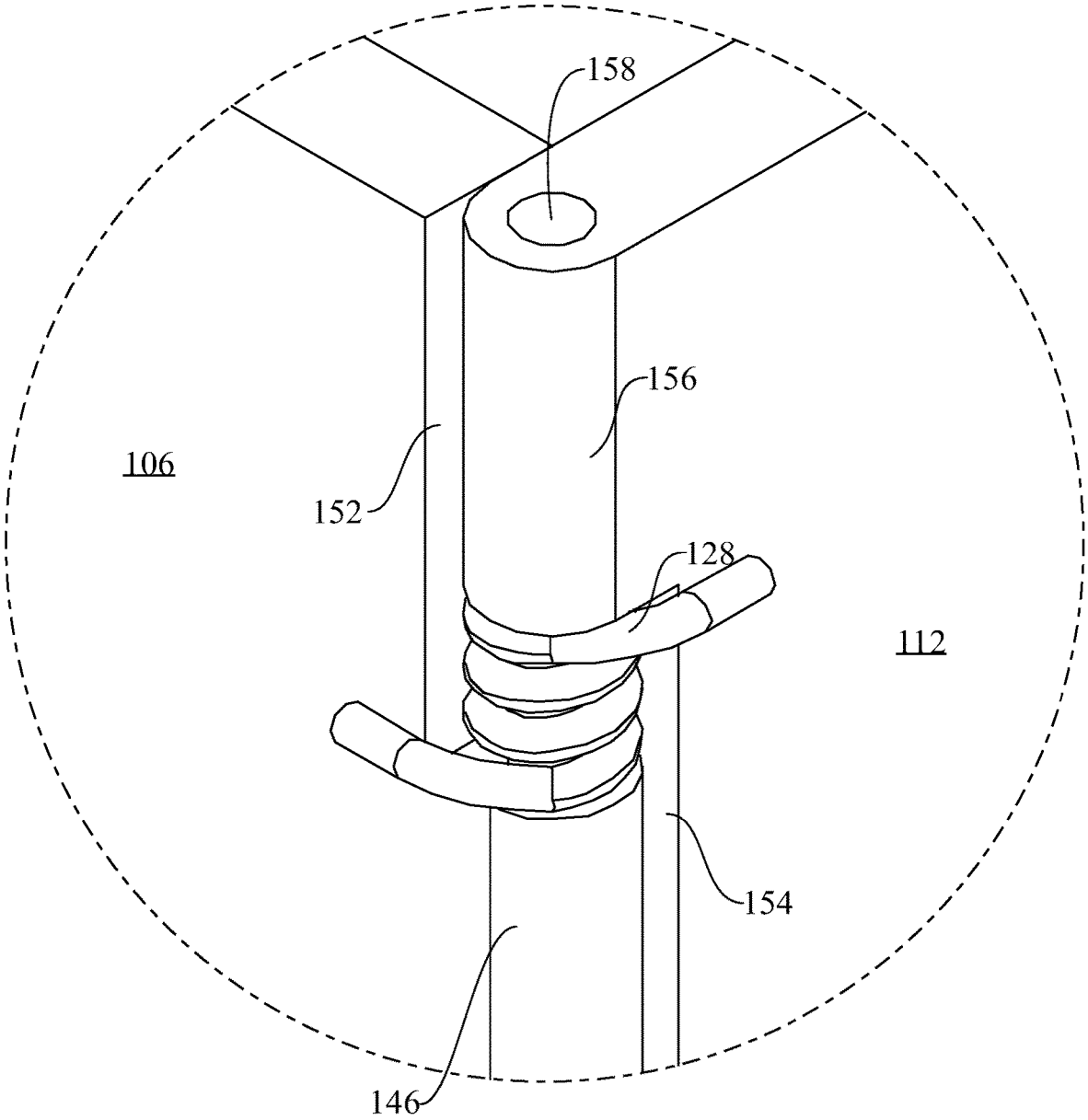

Referring now to FIGS. 6 and 7, the spring hinge front edge 118 can comprise a protruding centrally located section 146 which can be flush with plane of the side wall 106 and has a rounded edge 148 and can contain a channel 150 therethrough. The spring hinge front edge 118 can also contain flat sections 152 which are indented from the length of the protruding centrally located section 146, preferably indented at a distance which comports with the thickness 142 of the front spacer wall 106 described herein. The spring hinge front end 122 has a centrally located indentation 154 along its height which comports with, and when in place, mates with the height of the protruding centrally located section 146 of the spring hinge front edge 118. The two portions 156 of the spring hinge end 122 which are above and below the centrally located indentation 154 each can have a channel 158 therein which comports with the diameter of the channel 150 in the protruding centrally located section 146 described above. The dowel 126 can have the same diameter as the diameter of the channels 150 and 158 described herein and can have a length which comports with the height 136 of the sidewalls 106/108 and the front spacer wall 112.

Figure 2:
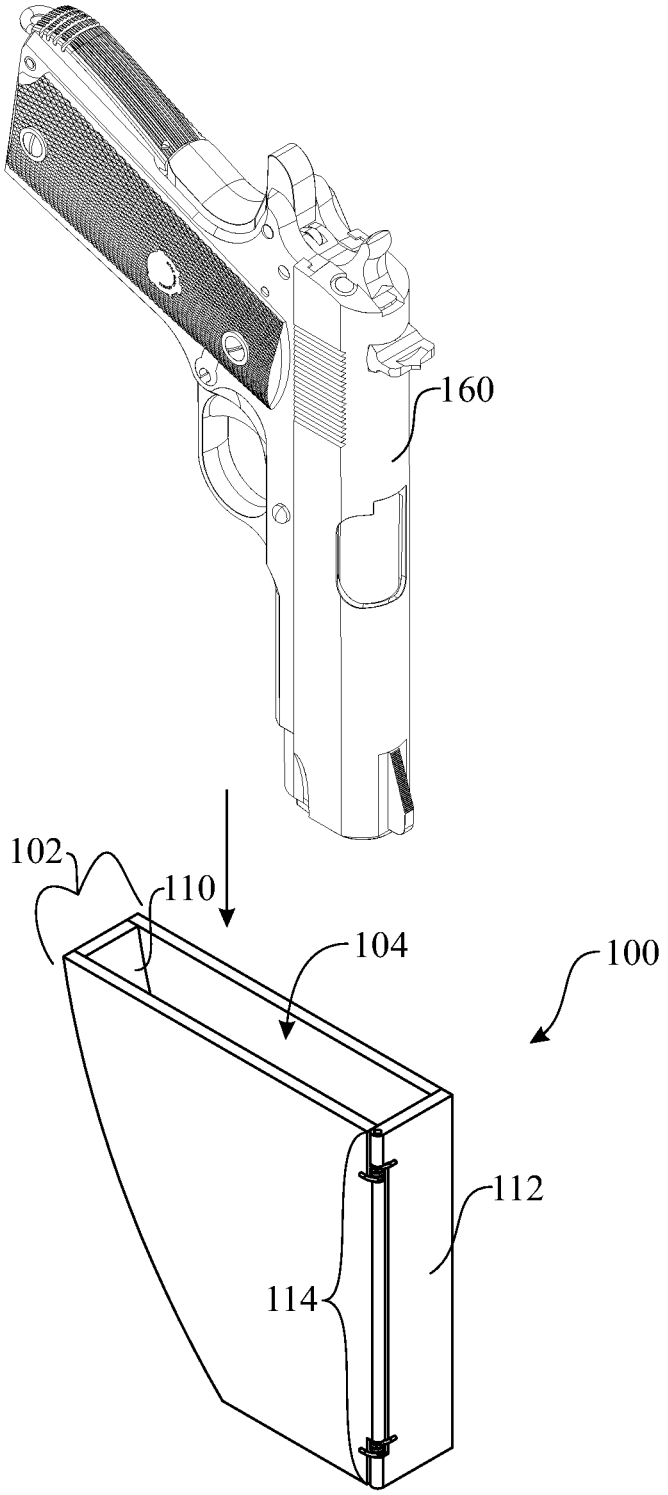
FIG. 2 is a view of a handgun located above the front-opening handgun holster of FIG. 1 showing the direction of inserting the handgun into the holster.
Figure 3:
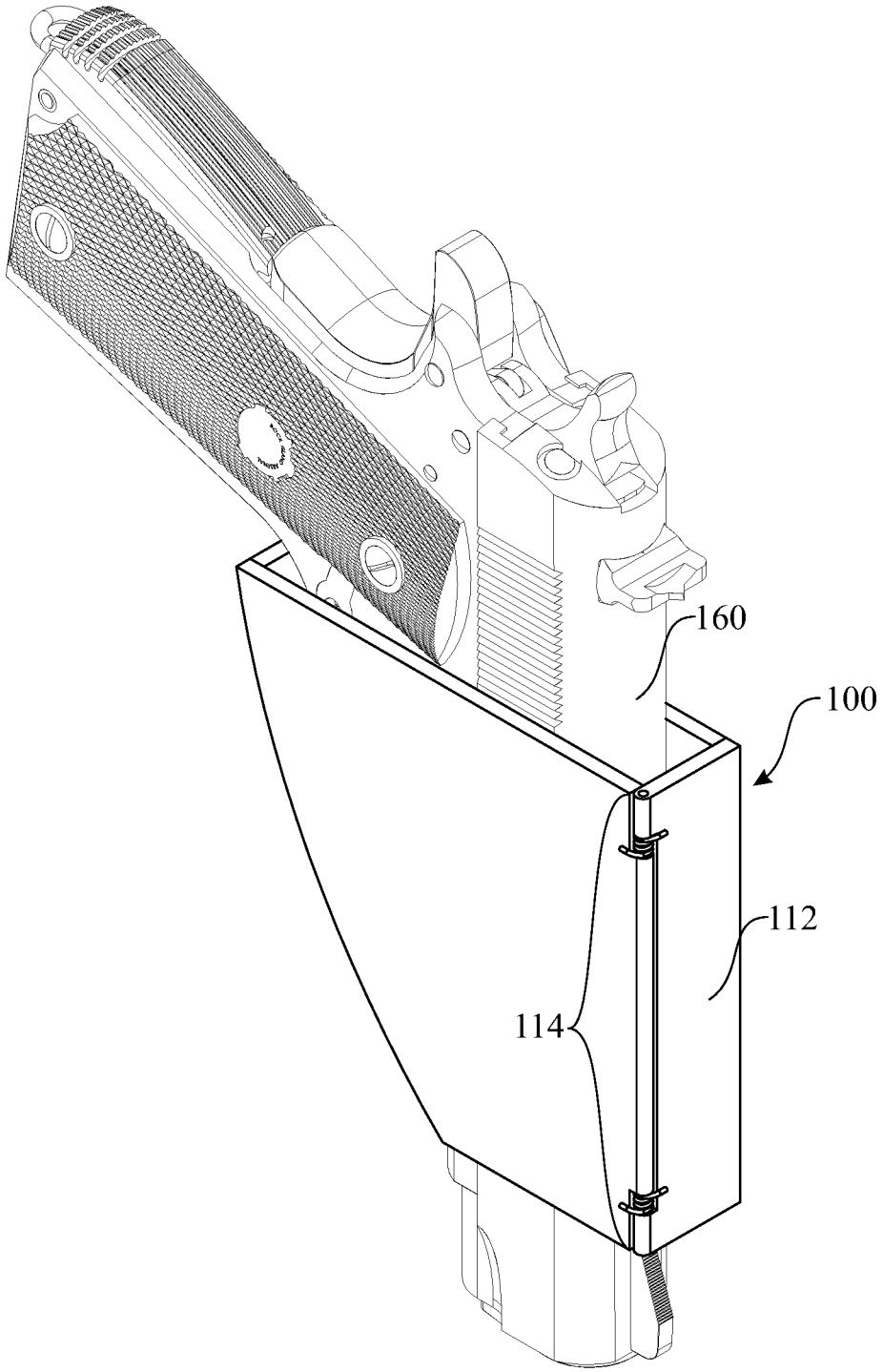
FIG. 3 is a view of a handgun situated in the front-opening handgun holster of FIG. 1.
Figure 4:
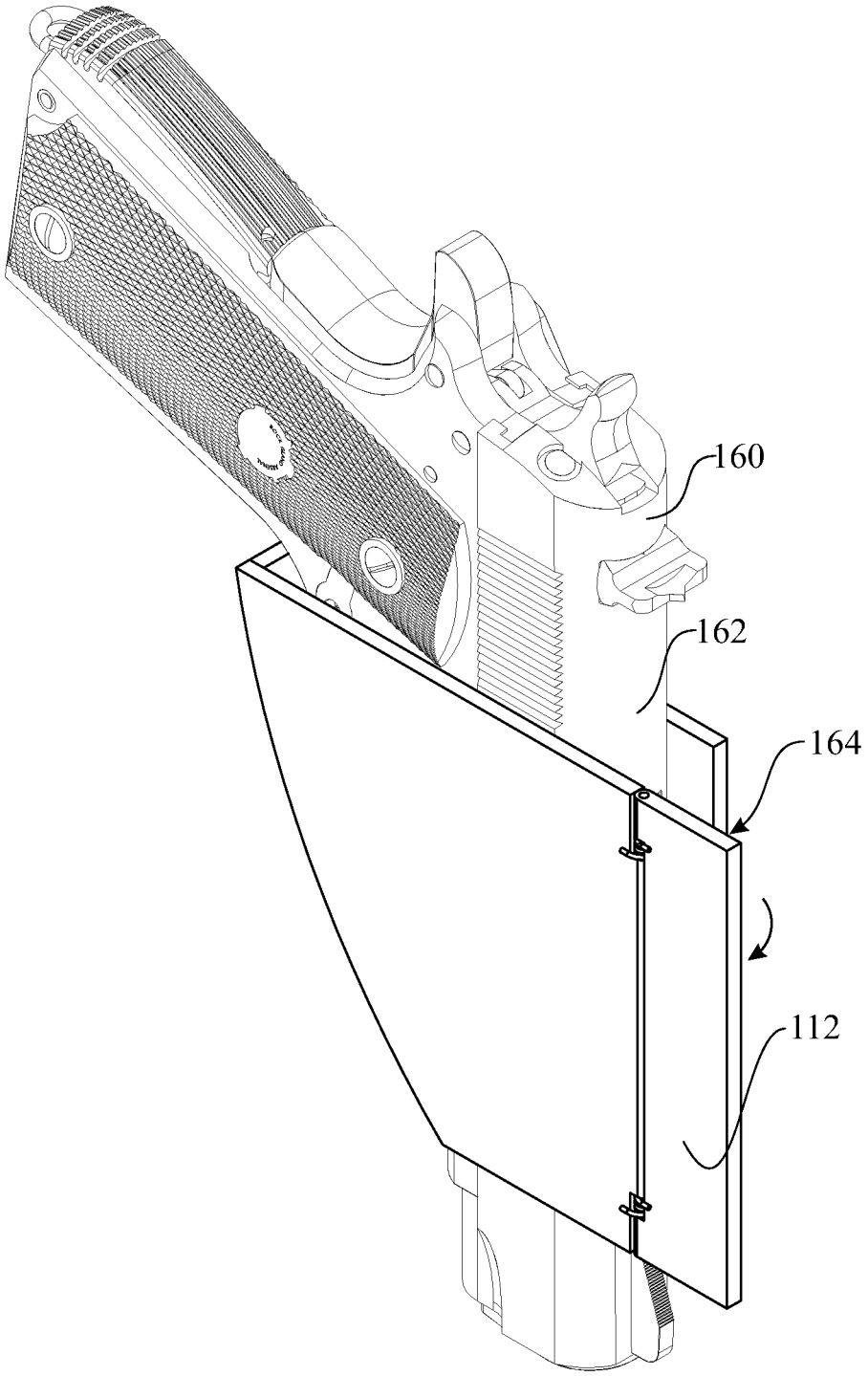
FIG. 4 is a view of the front spacer wall in FIG. 3 being opened.
Figure 5:
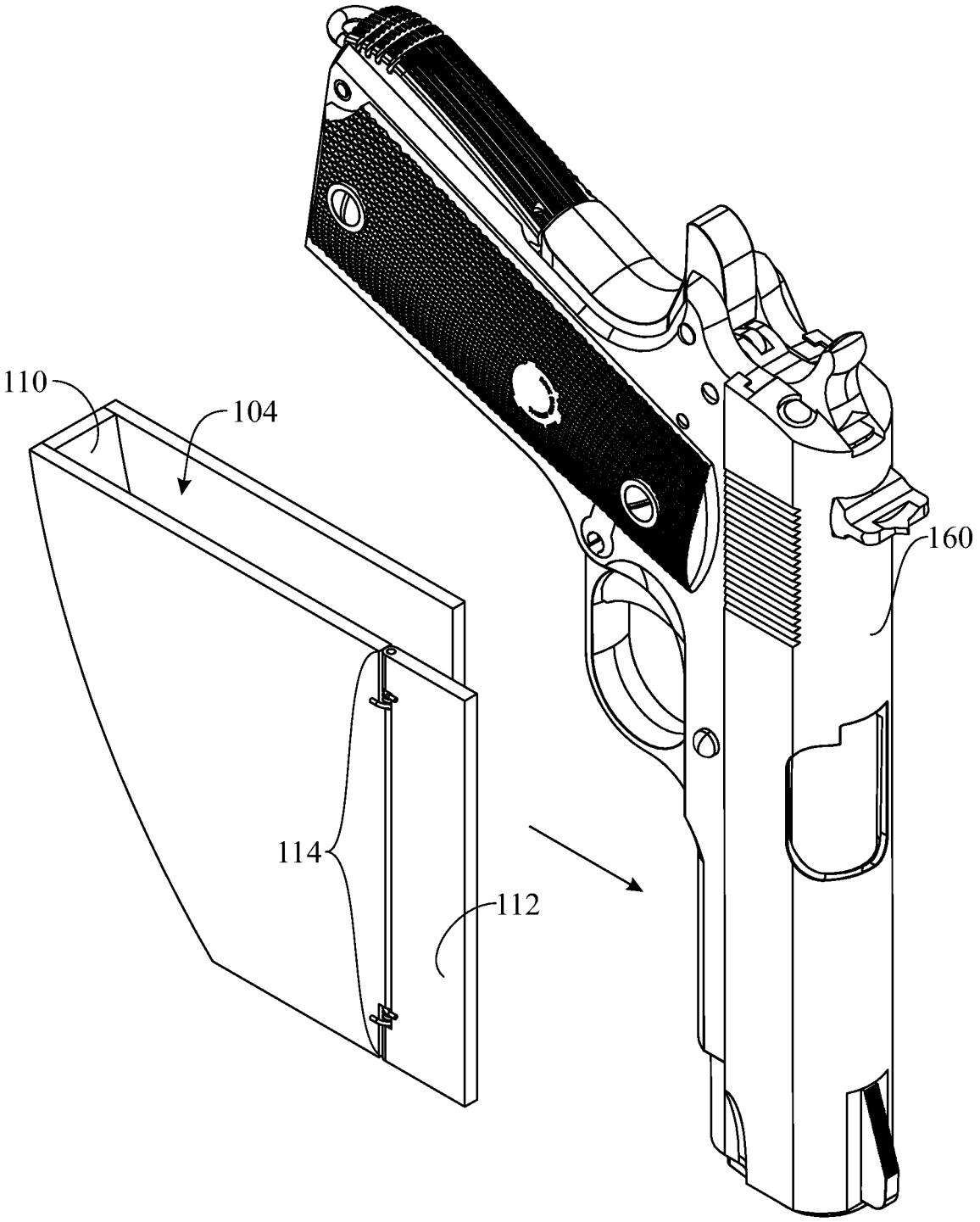
FIG. 5 is a view of the handgun being removed through the front spacer wall from the front-opening handgun holster of FIG. 4.

Referring now to FIGS. 2-5, the holster 100 can have a handgun 160 inserted into the cavity 104 of the holster 100 in the direction of the arrow shown in FIG. 2. The handgun 160 can rest and be secured in the holster 100 as shown in FIG. 3. When required to be presented the handgun 160 can be removed from the holster 100 by moving it towards the front spacer wall 112, such that the front spacer wall 112 swings open in the direction of the arrow shown in FIG. 4 by the contact of the barrel 162 of the handgun 160 with the inside 164 of the front spacer wall 112. This is further shown in FIG. 5 when handgun 160 has been completely removed from the holster 100 from the direction of the arrow in FIG. 5.

In an alternative embodiment herein the holster 100 described herein can be in the absence of any strap or enclosure over the top 130 of the holster 100. The holster 100 can be configured to have a universal fit for semi-automatic pistols and revolvers. Preferably the torsion springs 128 can have 2-4 coils therein, preferably 2-3 coils. The spring mechanism 114 described herein does not extend to the rear fixed wall 110 of the holster 100. Preferably the holster 100 can be configured such that it is level and not angled forward when in the designated orientation for use.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A front-opening handgun holster comprising:

a housing having an internal cavity with a rectangular cross section and which is planar and which is defined by:

two parallel side walls having rear sidewall edges, and opposing front edges, one of the front edges being a spring hinge front edge which is configured for reception of a spring mechanism, a fixed rear spacer wall located between the side walls, and which is flush with the rear sidewall edges, the fixed rear spacer wall having a width that comports with fixed spacing of the parallel side walls, and a front spacer wall having a spring hinge end which mates with the spring hinge front edge and an opposing closure end which overlies the other front edge; and, wherein the spring mechanism comprises a rod and at least two torsion springs, which are configured to fasten the spring hinge end of the front spacer wall to the spring hinge front edge.

2. The front-opening handgun holster of claim 1, wherein the handgun holster is of a size and configuration capable of accommodating either a semiautomatic pistol or a revolver.

3. The front-opening handgun holster of claim 1, wherein the handgun holster is made of a plastic selected from the group consisting of thermoplastic acrylic-polyvinyl chloride, injection molded polymer, leather, nylon and combinations thereof.

4. The front-opening handgun holster of claim 1, wherein, the housing is of a shape which can accommodates a specific type of handgun.

5. The front-opening handgun holster of claim 1, wherein the internal cavity of the housing is shaped to accommodate a single stack or double stack semi-automatic pistol.

6. The front-opening handgun holster of claim 1, wherein the housing has a rectangular opening to the internal cavity along a top of the two parallel side walls.

7. The front-opening handgun holster of claim 1, having a front opening which is rectangular and perpendicular to the sidewalls and is located between the spring hinge front edge and the other front edge.

8. The front-opening handgun holster of claim 1, wherein the two parallel side walls are flat.

9. The front-opening handgun holster of claim 1, wherein the sidewalls cover the trigger, trigger guard and at least 50%, of the length of the barrel of a handgun which is placed in the holster.

10. The front-opening handgun holster of claim 1, wherein the sidewalls of the housing have parallel and flush top and bottom edges.

11. The front-opening handgun holster of claim 1, wherein the parallel sidewalls have rear sidewall edges which are spaced apart by a distance of the width of the fixed rear spacer wall and which are identical and are curved along a height of the holster.

12. The front-opening handgun holster of claim 1, wherein the front edges of the sidewalls each have different configurations.

13. The front-opening handgun holster of claim 12, wherein one of the front edges of the sidewalls is a spring hinge front edge and is configured for reception of a spring mechanism such that the spring hinge front edge has a protruding centrally located section which is flush with plane of the side wall and has a rounded edge that contains a channel therethrough.

14. The front-opening handgun holster of claim 13, wherein the spring hinge front edge also contains flat sections which are indented from the length of the protruding centrally located section.

15. The front-opening handgun holster of claim 1, wherein the fixed rear spacer wall is curved in accordance with the curvature of the rear sidewall edges and is located between the sidewalls at the ends thereof.

16. The front-opening handgun holster of claim 1, wherein the front spacer wall and/or the side wall, adjacent to the front closure front edge has a button or latch mechanism which retains the front spacer wall in a closed position.

17. A method of removing a handgun from a holster comprising:

providing a front-opening handgun holster which contains:

a housing having an internal cavity with a rectangular cross section and which is planar and which is defined by:

two parallel side walls having rear sidewall edges, and opposing front edges, one of the front edges being a spring hinge front edge which is configured for reception of a spring mechanism, a fixed rear spacer wall located between the side walls, and which is flush with the rear sidewall edges, the fixed rear spacer wall having a width that comports with fixed spacing of the parallel side walls, and a front spacer wall having a spring hinge end which mates with the spring hinge front edge and an opposing closure end which overlies the other front edge; and, wherein the spring mechanism comprises a rod and at least two torsion springs, which are configured to fasten the spring hinge end of the front spacer wall to the spring hinge front edge;

fastening the front-opening handgun holster to an article of clothing;

inserting a handgun into the front-opening handgun holster, and, removing the handgun through the front spacer wall of the front-opening handgun holster.

18. The method of claim 17 further comprising wherein the article of clothing is a belt or a tactical clothing article.

* * * * *